US005628644A

United States Patent [19]

Szalay et al.

[11] Patent Number: 5,628,644

[45] Date of Patent: May 13, 1997

[54] NEGLIGIBLE INSERT FORCE POWER CONNECTOR

[75] Inventors: John S. Szalay, Corona Del Mar; Edward Rudoy, Woodland Hills, both of Calif.

[73] Assignee: Packard Hughes Interconnect Company, Irvine, Calif.

[21] Appl. No.: 525,470

[22] Filed: Sep. 8, 1995

[51] Int. Cl.[6] ..... H01R 13/15

[52] U.S. Cl. ..... 439/263; 439/841

[58] Field of Search ..... 439/259, 263, 439/268, 346, 841

[56] References Cited

U.S. PATENT DOCUMENTS

| | | | |
|---|---|---|---|
| 3,295,872 | 1/1967 | Kragle | 439/841 X |
| 3,380,017 | 4/1968 | Gomulka | 439/841 X |
| 5,154,626 | 10/1992 | Watson | 439/268 |
| 5,439,393 | 8/1995 | Watson | 439/268 X |

FOREIGN PATENT DOCUMENTS

| | | | |
|---|---|---|---|
| 2596210 | 9/1987 | France | 439/263 |
| 0111126 | 11/1917 | United Kingdom | 439/841 |

*Primary Examiner*—Khiem Nguyen

*Attorney, Agent, or Firm*—Cary W. Brooks

[57] ABSTRACT

The present invention provides a power connector having three components. A pin contact is provided having a contact area in the shape of a cylinder with the front end in the form of a cone or other shape with an extended surface. A socket contact is provided that is similar to the pin contact, except the front end is shaped to conform to the front end of the pin. A wound torsion spring is provided for biasing the pin contact and socket contact together. The torsion spring, pin contact and socket contact are carried in a receptacle connector, plug connector and back shell respectively which can be mated and unmated with negligible force.

4 Claims, 2 Drawing Sheets

NEGLIGIBLE INSERT FORCE POWER CONNECTOR

FIELD OF THE INVENTION

This invention relates to a power connector with negligible or zero insert force, and simultaneous electrical and mechanical locking features.

BACKGROUND OF THE INVENTION

The existing electrical interconnection systems are very complicated, have a variety of components and are difficult to assemble which greatly affects the costs of any product associated therewith. The present invention provides advantages over the prior art.

SUMMARY OF THE INVENTION

The present invention provides a power connector having three components. A pin contact is provided having a contact area in the shape of a cylinder with the front end in the form of a cone or other shape with an extended surface. A socket contact is provided that is similar to the pin contact, except the front end is shaped to conform to the front end of the pin. A wound torsion spring is provided for biasing the pin contact and socket contact together. The torsion spring, pin contact and socket contact are carried in a receptacle connector, plug connector and back shell respectively which can be mated and unmated with negligible force.

These and other objects, features and advantages of the present invention will become apparent from the following brief description of the drawings, detailed description and appended drawings and claims.

DETAILED DESCRIPTION

The major system of the described connector is configuration of the contacts. The contact system is composed of three components. Torsion spring 1, that can be formed out of rectangular or other profile conductive material. Pin contact 3 has the contact area in the shape of cylinder with the front end in the form of cone or other shape with extended surface. Socket contact 2 is similar to pin contact, except the front end will comply with the shape of the front end of pin. The opening (inside diameter) of the wound torsion spring is slightly larger, in free position, than the diameters of pin and socket in the engaging section, so the engagement of pin and socket in the spring contact does not require force.

Figure 3:
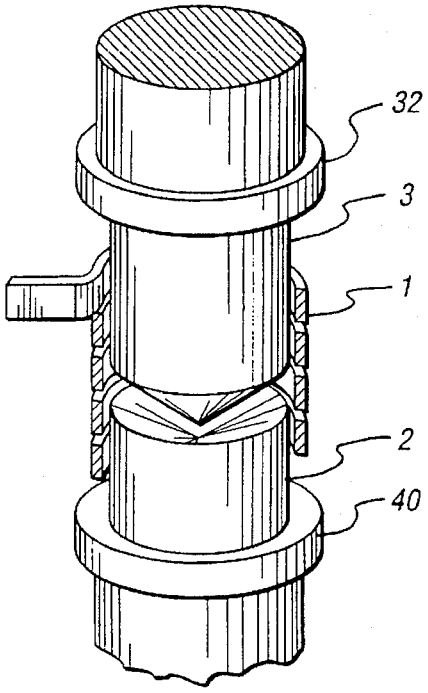
FIG. 3 is an enlarged view of a pin contact, socket contact and torsion spring assembled in a low contact, high electrical resistance relationship.
Figure 4:
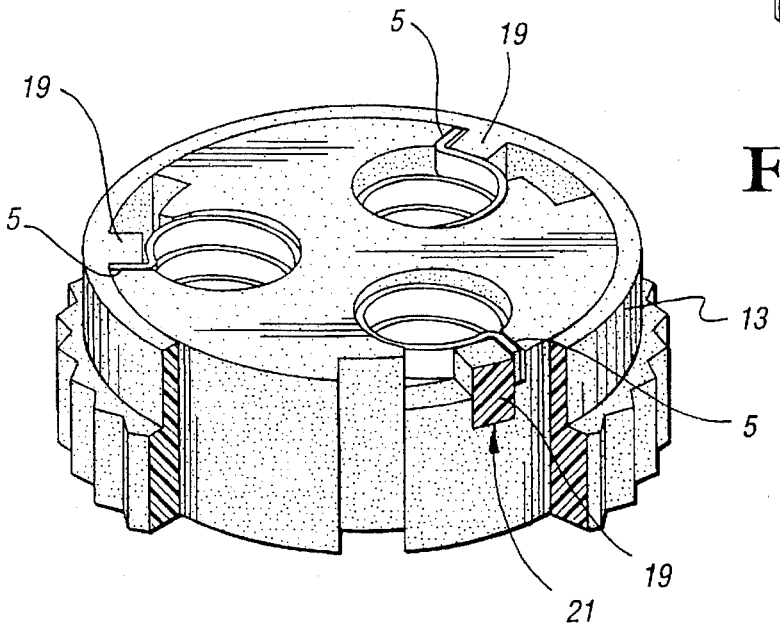
FIG. 4 is an enlarged view with portions broken away illustrating the mating position of the connector wherein the coupling ring boss traps the torsion spring tang.

When the pin and socket contacts are engaged, as shown in FIG. 3, the electric connection is not reliable and is highly resistive. To insure low contact resistance between pin and socket contacts, the spring motion of the contact has to be initiated by applying torque, in the winding direction of the torsion spring at the end of the first spring tang 5, which is formed outward, perpendicular to the spring axis. A second spring tang 4 at the other end of the torsion spring, formed the same way as the first one, and has to be contained. During this operation the inside diameter of the torsion spring is reduced and torsion spring tightly wraps around cylindrical surfaces of pin and socket contacts, providing low resistance electrical contact.

The same result can be accomplished with reverse operation of the torsion spring. The torsion spring is formed with inside diameter smaller than cylindrical diameter of engaging ends of pin and socket contacts. Before the engagement, the contact spring is torque in the direction of unwinding. This operation will increase the inside diameter of the spring contact, allowing pin and socket contacts to enter the spring contact without resistance. Upon release of the torque, the inside diameter of the contact spring reduces, wrapping around both cylindrical surface of pin and socket contact, providing electrical connection.

Figure 1:
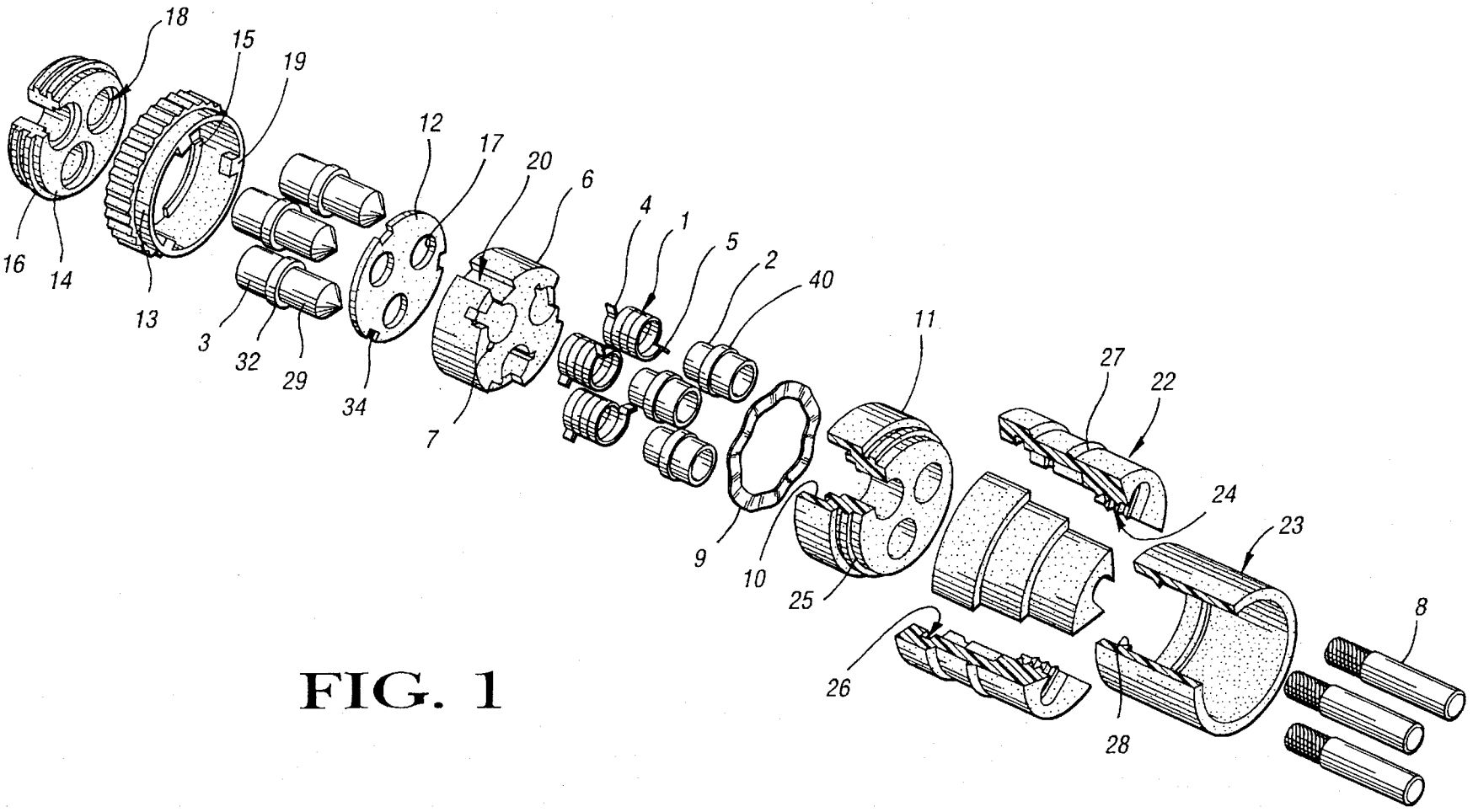
FIG. 1 is an exploded view, with portions broken away of a negligible insert for a power connector according to the present invention.
Figure 2:
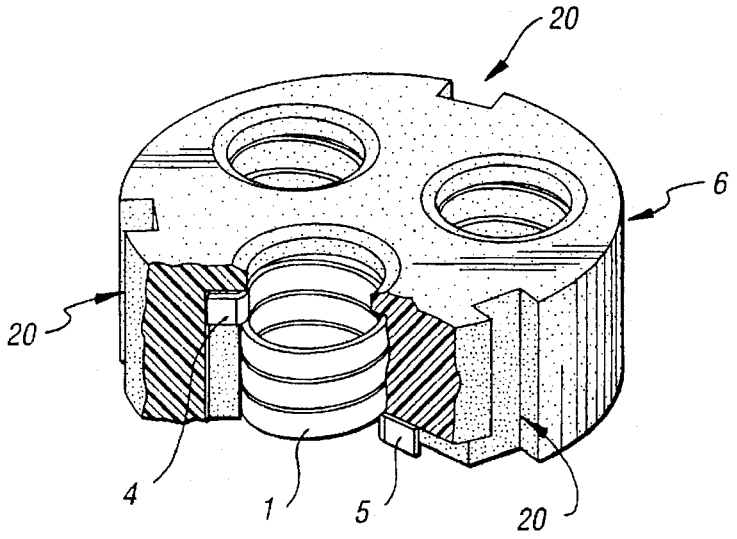
FIG. 2 is an enlarged, with portions broken away, perspective view of a receptacle connector shown in FIG. 1 with the torsion spring in place.

The negligible insert force power connector includes a receptacle connector, a plug connector and a back shell/cable strain relief described as follows. A receptacle connector is provided by installing the torsion spring 1 in a cavity of a middle socket insulator block 6. The second spring tang 4 of the spring 1 is captured in a slot 7 formed next to the cavity. The first spring tang 5 of the spring 1 is preloaded with the tip extended and exposed (see FIG. 2).

Socket contact 2 is terminated (secured by solder or otherwise) to cable 8. The socket contact 2 has an outer annular rib 40 that is frictional fit into an aperture 42 formed in the middle socket insulator block 6 in the way that the socket contact 2 will engage with the torsion spring 1. A wave washer 9 placed in an annular groove 10 formed in a rear socket insulator block 11. Attaching middle 6 and rear 11 socket insulator blocks will capture components 1, 2, 8 and 9 in receptacle connector subassembly.

A plug connector is provided so that the pin contact 3 is terminated (secured by solder or otherwise) to a cable (the same as 8 on the pin side, but not shown). The pin contact 3 has an outer rib 32 that is press fit into the aperture 18 in the front insulation block 14. The front plug insulator plate 12 has apertures 17 defined therein for receiving the pin contact 3. The plate 12 also has notches 34 formed in the annular edge of the plate so that the plate can be moved past a boss 19 formed along the front inside edge of the coupling ring 13 and so that the ring is held in place by the boss 19. The plate is also held in place by the close fix of an elongated portion 29 of the pin contact 3. An inner annular lip 15 of a coupling ring 13 is captured in the groove created by plug insulator plate 12 and an outer annular rib 16 formed on the front socket insulator block 14 allowing coupling ring 13 to rotate freely.

A back shell 22 is composed of three segments and a locking ring 23. The back shell is attached to the rear socket insulator block through outer rib 25 on the insulator 11 and groove 26 inside annular in the back shell 22, and locked in place with the ring 23. Interlocking of the ring 23 and back shell 22, are accomplished through interference fit annular rib 27 on outer surface of the back shell 22, and an annular rib 28 on the inside wall of locking ring 23. To secure cable 8 attachment to the connector, series of ribs 24 on the upper portion of the inside wall of the back shell 22 will penetrate into insulation of the cable 8.

The components of the system may be mated as follows. The extended cylindrical section 29 of the pin contact 3 is penetrated into cavity in the middle socket insulator block 6 (with components assembled as described in the section "receptacle connector"), without meeting resistance. A boss 19 of the coupling ring 13 is sliding into the a longitudinal groove 20 formed on the outer wall of middle socket insulator block 22 until it will reach and compress the wave spring 9. During the following clockwise rotation of the coupling ring 13, the boss 19 picks up the first spring tang 5 of the torsion spring 1 and torques it as described. When the boss 19 arrives to the slot 21 formed on an upper face of block 6, the energy from the wave spring 9 forces (detent) the boss 19 into slot 21 capturing the tang 5 in a locking position, actuating contacts and interlocking connectors. Mating is completed.

The components of the system may be unmated as follows. Compressing or moving the coupling ring 13 toward receptacle connector will disengage boss 19 from slot 21. The counterclockwise rotation of the coupling ring 13 disengage contacts and when the boss 19 reaches groove 20 and moved downward, the first spring tang 5 is released causing torsion spring to uncoil (decompress) and unmating is completed.

What is claimed is:

1. A negligible insert force power connector comprising:

a socket connector block having a plurality of holes formed therein and a torsion spring carried in each of said holes, said torsion spring having a first tang at one end for engaging the first socket connector block and a second tang at the other end of the torsion spring;

a socket contact having one end secured to a wire and a second end inserted into the hollow of the torsion spring;

a plug connector block having a plurality of pin contacts received therein, each pin contact having a contact area in the shape of a cylinder with the front end having an extended surface, said plug connector having a boss positioned to engage the second tang of the torsion spring when the pin contact is inserted into the hollow portion of the torsion spring, and so that upon rotation of the plug connector the boss picks up the second tang of the torsion spring compressing the torsion spring and causing the pin contact and socket contact to engage each other and provide electrical connection between respective wires.

2. A negligible insert force power connector comprising:

a front and middle and rear socket insulator block;

a middle socket insulator block having a plurality of cavities formed therein and a first and second slot each intersecting said cavity and a longitudinal groove formed in an outer wall of said middle socket insulator block and intersecting said cavity, a wound hollow torsion spring received in each cavity, said wound torsion spring having a first outwardly extending tang at one end and a second outwardly extending tang at the other end and so that said second tang is captured in said second slot and the first tang is extended and exposed;

a rear socket insulator block having a plurality of holes formed therethrough corresponding the cavities in the middle socket insulator block, and a wave spring received in an annular groove formed in the rear socket insulator block;

a socket contact secured to a first wire, said socket contact being received in the hollow portion of the wound torsion spring and said first wire extending through a hole formed in the rear socket insulator block and through the back shell;

a pin contact secured to a second wire, said pin contact having a male portion with an extended end and said socket contact having a mating portion for said male portion;

a pin contact insulation plate having a plurality of apertures therein and said pin contact extending through an aperture;

a coupling ring having an annular lip for carrying said pin contact insulation plate, said coupling ring having a boss for being received in the longitudinal groove in said middle socket insulator block, and first and second wires may be electrical and mechanical connected by insertion of the male portion of the contact pin into the hollow portion of said torsion spring and said boss may be inserted into the longitudinal slot formed on an outside wall of the middle socket insulator block until it reaches and compress the wave spring, and so that upon clockwise rotation of the coupling ring the boss picks up the first tang of the torsion spring and torques the torsion spring and upon intersection of the boss with the first slot, the wave spring forces the boss into a locked position in the first slot and said pin and socket contact are actuated into interlocking contact, and so that the wire may be unmated by the coupling ring toward the rear socket insulator block to disengage the boss from the first slot and rotating the coupling ring counterclockwise until the boss reaches the longitudinal groove formed on the outside wall of the middle socket insulator block, and thereafter moving the coupling ring away from the rear socket insulator block to release the first tang causing the torsion spring to uncoil.

3. A negligible insert force power connector as set forth in claim 2 further comprising a front socket insulator block having a plurality of cavities formed therein each for carrying a portion of a pin contact, said connected to said coupling ring so that said coupling ring is free to rotate.

4. A negligible insert force power connector as set forth in claim 2 further comprising a back shell having cylindrical shape and an annular groove formed in an inside wall near one end of the back shell and a series of ribs formed on the inside wall near another end of the back shell, said rear socket insulator block having an annular rib formed on an outer wall thereof in which the rib on the outer wall of the back shell is received, said first wire being secured to the back shell by said series of ribs formed on the inside wall of the back shell wherein said ribs penetrate into an insulation formed on the first wire.

* * * * *